US006422881B1

(12) United States Patent
Puhl et al.

(10) Patent No.: US 6,422,881 B1
(45) Date of Patent: Jul. 23, 2002

(54) ELECTRICAL CONNECTOR HAVING A BLADE STABILIZER

(75) Inventors: Ronald A. Puhl, Poland; Courtney A Mansky, Youngstown; John H. Bakker, Cortland, all of OH (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/795,692

(22) Filed: Feb. 27, 2001

(51) Int. Cl.[7] ..... H01R 13/44

(52) U.S. Cl. ..... 439/140

(58) Field of Search ..... 439/140, 141, 439/752, 598

(56) References Cited

U.S. PATENT DOCUMENTS

| | | | | |
|---|---|---|---|---|
| 5,501,606 A | * | 3/1996 | Oda et al. | 439/140 |
| 5,810,612 A | | 9/1998 | Flask et al. | 439/157 |
| 5,879,174 A | * | 3/1999 | Kountz et al. | 439/141 |
| 6,048,226 A | | 4/2000 | Iwahori | 439/595 |

OTHER PUBLICATIONS

GT Lever Lock Electrical Connector Product of Delphi Automotive Systems, Troy, MI 48007; dated at least as early as Feb. 1, 2000.

* cited by examiner

*Primary Examiner*—Brian Sircus
*Assistant Examiner*—Javaid Nasri
(74) *Attorney, Agent, or Firm*—Thomas N. Twomey

(57) ABSTRACT

A multi-blade electrical connector featuring a guidingly movable blade stabilizer which prevents blade misalignment and foreign article entry into the blade environment. A shroud provides a shroud cavity which communicates with terminal cavities. A bladed terminal is received in a respective terminal cavity, wherein the blade thereof projects into the shroud cavity. The shroud has a top wall and a bottom wall and have formed therein at least one pair of mutually opposed slot sets, each being composed of a prestage slot and a staging slot mutually aligned and separated by a prestage detent. The blade stabilizer has a plurality of blade apertures for snugly receiving a blade, respectively. Opposing edges of the blade stabilizer each have at least one staging nib for being respectively received into the at least one prestage and staging slots, wherein the blade stabilizer is at a prestage position when the staging nibs are at the prestaging slots, and at a sliding staging position when at the staging slots.

15 Claims, 4 Drawing Sheets

ELECTRICAL CONNECTOR HAVING A BLADE STABILIZER

TECHNICAL FIELD

The present invention relates to electrical connectors, and more particularly an electrical connector having a plurality of blade terminals therewithin. Still more particularly, the present invention relates to an electrical connector of the aforesaid type incorporating a blade stabilizer which is guidingly positionable between a prestaged position and a staged position.

BACKGROUND OF THE INVENTION

Multi-blade electrical connectors have a number of bladed terminals (ie., male terminals), and are typically configured with a separate cavity for each terminal and a shroud surrounding a projecting blade of each of the terminals. The cavity and terminal are cooperatively configured so that when the terminal is inserted thereinto from an end of the connector opposite of the shroud, a mutual locking interaction ensues which fixedly locates the terminal in the cavity.

There are two problems associated with conventional multi-blade electrical connectors. A first problem relates to potential for blade misalignment. Blades may become bent or otherwise misaligned, resulting in inability of any misaligned blades to electrically connect with its counterpart terminal of a mating electrical connector. A second problem relates to one or more foreign articles potentially entering into the blade environment within the shroud and thereupon becoming lodged amongst the blades, resulting in an inability to properly mate the multi-blade electrical connector to its mating electrical connector.

Accordingly, what remains needed in the art is a multi-blade electrical connector which is configured to prevent blade misalignment and foreign article entry into the blade environment.

SUMMARY OF THE INVENTION

The present invention is a multi-blade electrical connector featuring a guidingly movable blade stabilizer which prevents blade misalignment and foreign article entry into the blade environment.

A multi-bladed electrical connector has a connector body featuring a shroud at one end and a plurality of terminal cavities at the other end. The shroud provides a shroud cavity which communicates with the terminal cavities. A bladed terminal is lockably received in a respective cavity, wherein the blade thereof projects into the shroud cavity. The shroud has a top wall, an oppositely disposed bottom wall and a pair of mutually opposing side walls extending between the top and bottom walls, each of which forming a respective interior wall surface. The shroud walls have formed therein at least one pair of mutually opposed slot sets, each being composed of a prestage slot and a staging slot mutually axially aligned (along a terminal axis) and separated by a prestage detent.

A blade stabilizer has a planar shape defined by an edge periphery which generally conforms to the aforesaid interior wall surfaces of the shroud. The blade stabilizer is provided with a plurality of blade apertures, each blade aperture being located so as to snugly receive a respective blade when the edge periphery of the blade stabilizer adjoins the interior wall surfaces and the plane thereof is perpendicular to the terminal axis. Opposing edges of the blade stabilizer each have at least one staging nib for being respectively received into the slot sets.

In operation, the multi-blade electrical connector is preliminarily assembled, including placement of the blade stabilizer into the shroud cavity at a prestage position whereat the staging nibs are received into their respective prestage slots. At this presage position of the blade stabilizer, assembly is completed by each blade being placed into its respective terminal cavity so that the blade thereof passes through a respective blade aperture, with only a small portion of the blade (the end of the blade tips extending outwardly therebeyond). As a mating electrical connector is inserted into the shroud cavity, the forward face of the mating electrical connector presses upon the blade stabilizer and forces the staging nibs to become snappingly pressed out of the prestage slots, ride over the prestage detent and become resiliently received by the staging slots.

Referring now to the Drawing, FIG. 1 shows a multi-blade electrical connector 10. The preferred multi-blade electrical connector 10 has a configuration for connecting to a mating electrical connector 100 (see FIG. 7), preferably including a cam lock lever, similar to that described in U.S. Pat. No. 5,810,612 to Flask et al., issued Sep. 22, 1998, the disclosure of which is hereby incorporated herein by reference.

Accordingly, it is an object of the present invention to provide a multi-blade electrical connector with a guidingly movable blade stabilizer which prevents blade misalignment and foreign article entry into the blade environment.

This and additional objects, features and advantages of the present invention will become clearer from the following specification of a preferred embodiment.

DESCRIPTION OF THE PREFERRED EMBODIMENT

Figure 1:
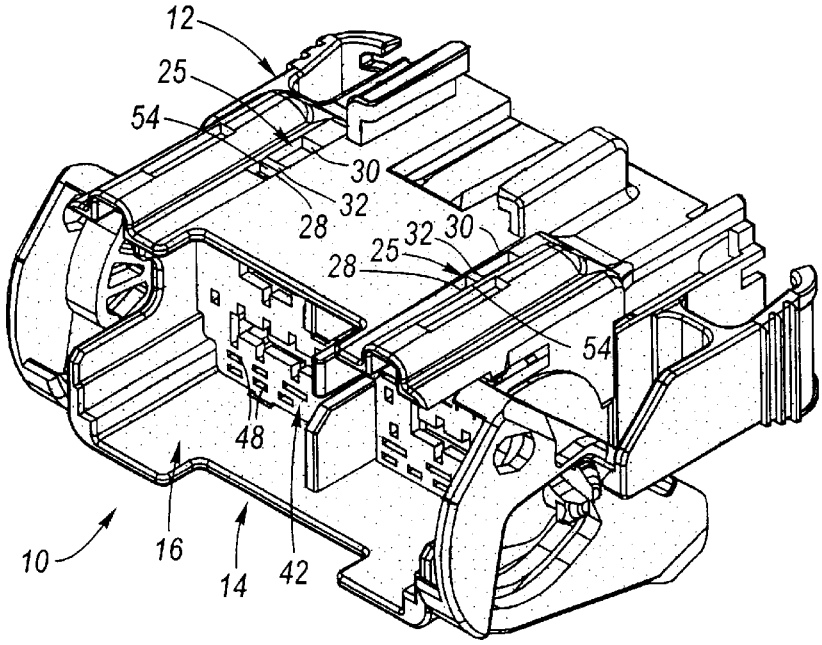
FIG. 1 is a perspective view of a multi-blade electrical connector with blade stabilizer according to the present invention.
Figure 2:
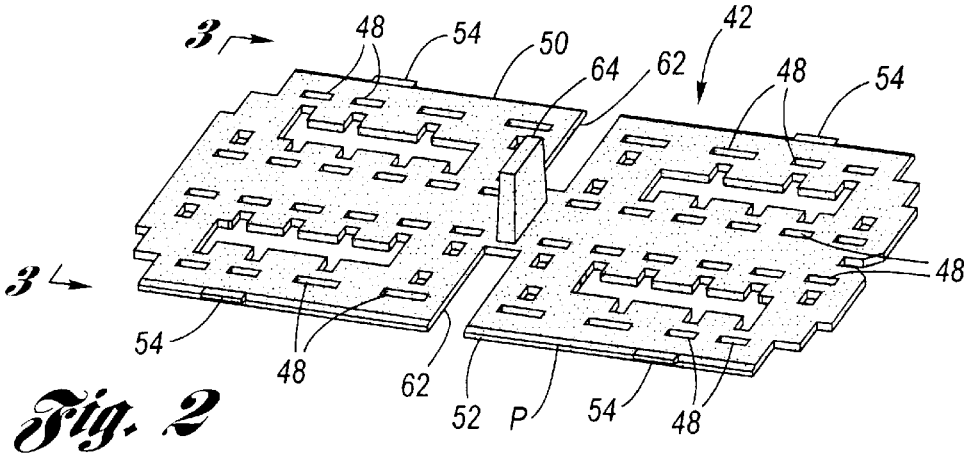
FIG. 2 is a perspective view of the blade stabilizer according to the present invention.
Figure 3:
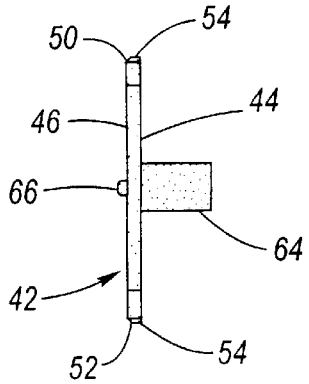
FIG. 3 is an end view of the blade stabilizer, seen along line 3—3 of FIG. 2.

Referring now to the Drawing, FIG. 1 shows an example of a multi-blade electrical connector 10. The preferred multi-blade electrical connector 10 has a configuration for connecting to a mating electrical connector 100 (see FIG. 7), preferably including a cam lock lever, similar to that described in U.S. Pat. No. 5,810,612 to Flask et al., issued Sep. 22, 1998, the disclosure of which is hereby incorporated herein by reference.

The multi-bladed electrical connector 10 has a connector body 12 which is preferably composed of a plastic material.

Figure 5:
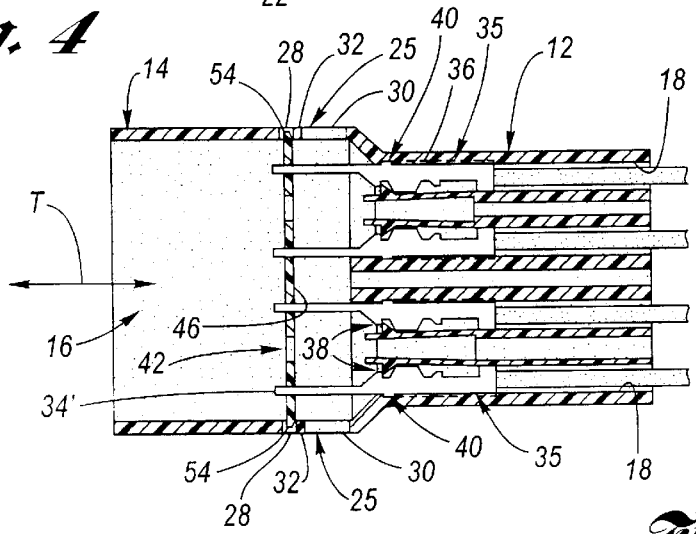
FIG. 5 is a partly sectional side view of the multi-blade electrical connector with blade stabilizer, seen along line 5—5 of FIG. 4, wherein the blade stabilizer is shown at its prestaged position.
Figure 6:
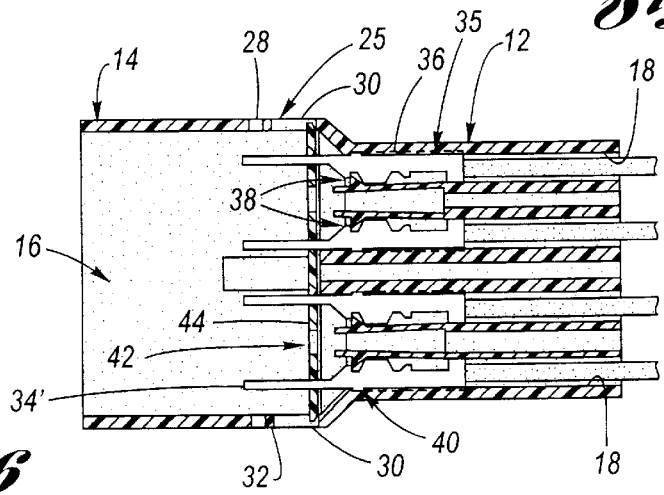
FIG. 6 is a partly sectional side view similar to FIG. 5, wherein now the blade stabilizer is shown at its staged position.

A forward end of the connector body features a shroud 14 which defines therewithin a shroud cavity 16. At a rearward end of the connector body a plurality of terminal cavities 18 are provided (see FIGS. 5 and 6). The shroud cavity 16 communicates with each of the terminal cavities 18.

The shroud 14 has a top wall 20, an oppositely disposed bottom wall 22 and a pair of mutually opposing side walls 24, 26 extending between at least a portion of the top and bottom walls. Each of the top, bottom and side walls provide a respective interior wall surface 20', 22', 24', 26'. The top and bottom walls 20, 22, each have formed therein a pair of mutually spaced apart slot sets 25, each composed of a prestage slot 28 and a staging slots 30 separated by a prestage detent 32, wherein each prestage slot is mutually axially aligned (along a terminal axis T) with a respective staging slot. Each of the prestage and staging slots 28, 30 have generally identical widths; however, the prestage slot has a length much shorter than the length of the staging slots (elongated along the terminal axis T). For example, the length of the prestage slots 28 may be approximately just less than the width, whereas the length of the staging slots 30 may be approximately three times the width.

The terminal cavities are generally conventional 18, wherein cavity walls define and demarcate each terminal cavity from each other terminal cavity. Further, the connector body 12 determines the location of each terminal cavity in fixed spatial relation to each other terminal cavity. The terminal cavities 18 are configured with open forward and rearward ends, wherein, as mentioned above, the forward end communicates with the shroud cavity 16.

A bladed terminal 35 is configured to be inserted into a respective cavity terminal 18, for example from the rearward end thereof. The bladed terminals 35 each include a blade 34 and a terminal body 36 to which is connected an electrical wire. Each terminal cavity 18 and terminal body 36 are cooperatively provided with a locking feature 38 and a location feature 40 which serve to lockably receive a bladed terminal 35 therein, wherein the blade 34 thereof projects into the shroud cavity 16.

Figure 4:
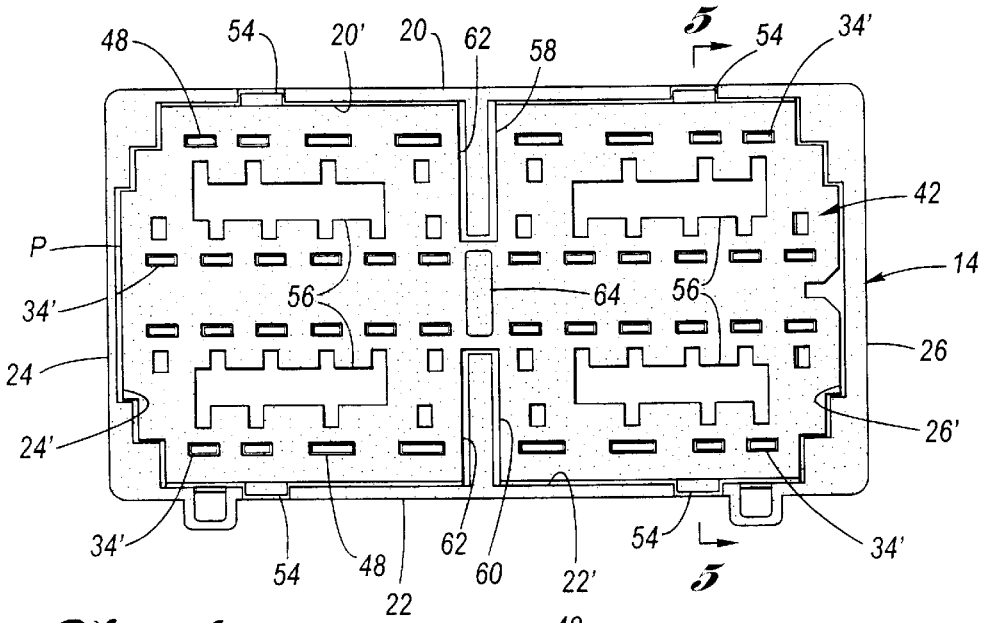
FIG. 4 is a front view of the multi-blade electrical connector with blade stabilizer according to the present invention.

A blade stabilizer 42 is preferably composed of a plastic material, and is configured to fit into the shroud cavity 16 so as to locatably receive therethrough the projecting blades 34 (see FIG. 4). The blade stabilizer 42 has a planar shape, an edge periphery P which generally conforms to the aforesaid interior wall surfaces 20', 22', 24', 26' of the shroud 14, a forward side 44 and an opposite rearward side 46. A plurality of blade apertures 48 are formed in the blade stabilizer passing from the forward to the rearward sides in perpendicular relation thereto. A blade aperture 48 is provided for each blade 34 in exact alignment therewith when the edge periphery adjoins the shroud interior wall surfaces 20', 22', 24', 26' and the plane of the blade stabilizer is perpendicular to the terminal axis T. In a preferred form of the blade stabilizer 42, the blade apertures 48 at the rearward side 46 (that is, the side facing toward the terminal cavities) are beveled to facilitate blade entry.

Opposing top and bottom edges 50, 52 of the blade stabilizer 42 each have a pair of mutually spaced apart staging nibs 54, located for being respectively received into the slot sets 25. In a preferred form of the blade stabilizer 42, the edge periphery P is beveled at the rearward side 46, and cut-outs 56 are formed therein to provide a predetermined level of flexibility and minimize the amount of material utilized.

In the preferred multi-blade electrical connector 10, the interior wall surfaces 20', 22' are provided with mutually opposed connector alignment tabs 58, 60 which are upstandingly oriented in mutual alignment. Accordingly, the preferred blade stabilizer 42 includes notches 62 for receiving the alignment tabs 58, 60, and further includes an upstanding stabilizer tab 64 connected to the forward side. A stiffening rib 66 is preferably provided at the rearward side.

Figure 7:
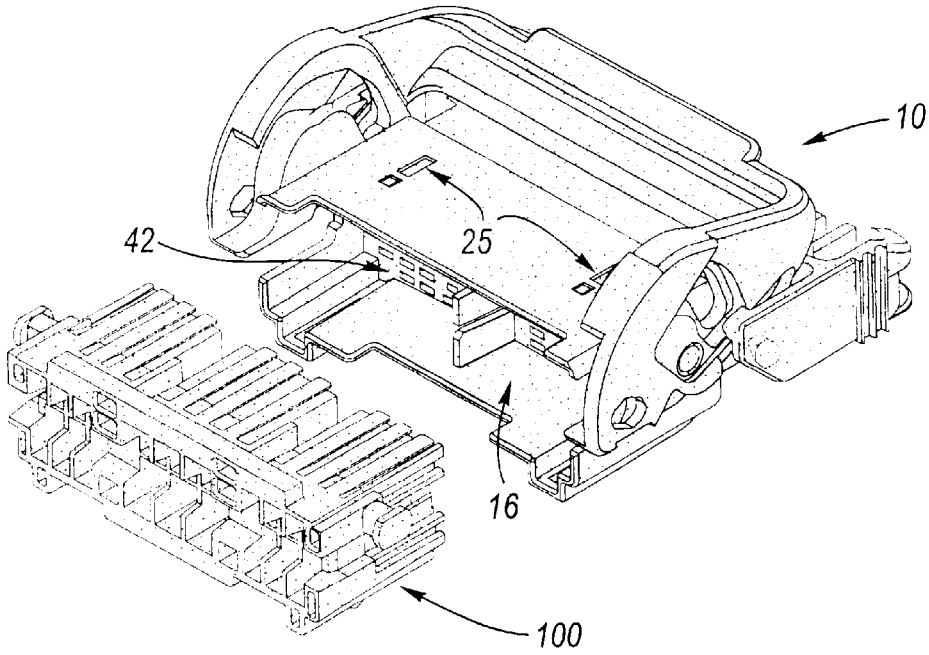
FIGS. 7 through 10 are progressive views of staging of the multi-blade electrical connector with blade stabilizer according to the present invention with respect to a mating electrical connector.

Referring now additionally to FIGS. 7 though 10, operation of the multi-blade electrical connector 10 will be detailed.

The multi-blade electrical connector is initially assembled, including placement of the blade stabilizer 42 into the shroud cavity 16, wherein the edge periphery P generally adjoins the interior walls 20', 22', 24', 26' and the plane of the blade stabilizer is perpendicular to the terminal axis T, and wherein the blade stabilizer is at its prestage position whereat the staging nibs 54 are received into their respective prestage slots 28. The nibs and prestage slots interaction holds the blade stabilizer at the prestage position both in terms of its ability to move axially toward or away from the terminal cavities unless at least a predetermined amount of force acts axially on the blade stabilizer (ie., a mating force of a mating electrical connector).

Next, the bladed terminals 35 are lockably received into their respective terminal cavities 18 by sliding entry thereinto from the rearward end thereof, wherein the tips 34' of the blades 34 each pass through a respective blade aperture 48 with only a minimal portion of the blades (ie., the ends of the blade tips) extending outwardly therebeyond (see FIGS. 1, 4 and 7).

Figure 8:
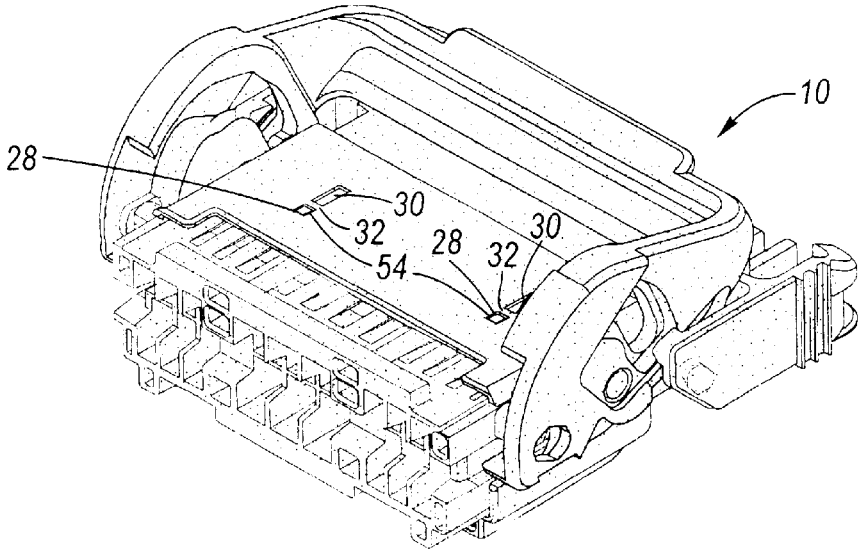
Figure 9:
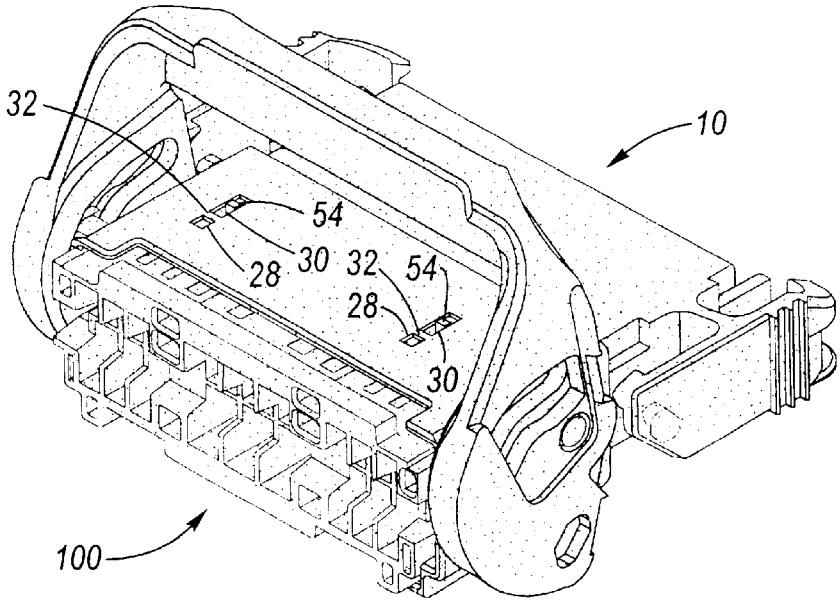

As a mating electrical connector 100 is inserted into the shroud cavity (see FIGS. 7 and 8), the forward face 102 of the mating electrical connector presses upon the forward side of the blade stabilizer and forces the staging nibs to snappingly become pressed out of the prestage slots, ride over the prestage detent 32 and resiliently rebound receivingly into the staging slots 30 (see FIG. 9). In this regard, the staging slot 30 is sufficiently elongated so that the staging nibs 54 are able to move therealong as the blade stabilizer slides along the blades to its fully staged position in response to the mating electrical connector 100 being fully mated with respect to the multi-blade electrical connector 10.

Figure 10:
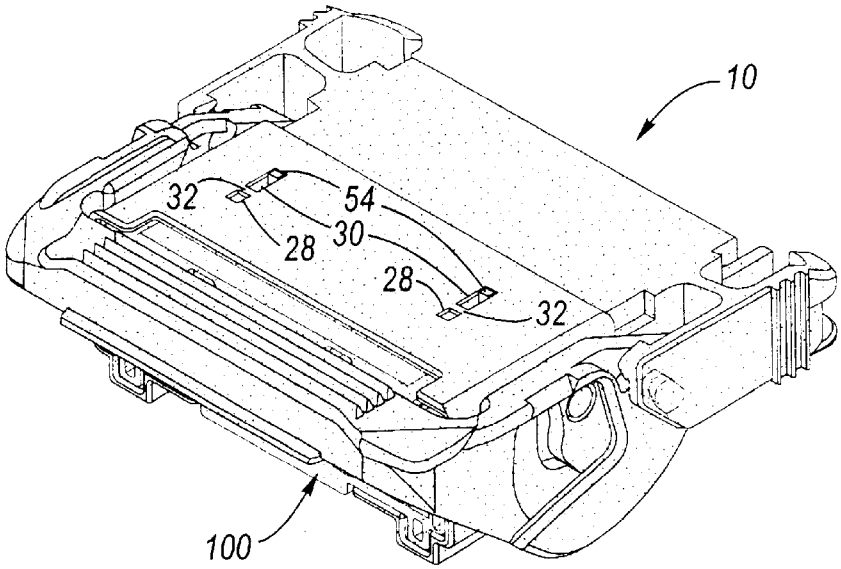

Further insertion of the mating electrical connector to its fully mated position (see FIGS. 9 and 10) results in the blade stabilizer sliding with the forward face to its fully staged position, as the staging nibs are guidingly slid along the staging slots.

The major feature of the present invention is that a releasable interlock is provided, structurally by way of preferred example by the action of the nibs in the prestage slots, which holds the blade stabilizer at the prestage position in both axial directions (toward and away from the terminal cavities) unless at least a predetermined level of axial force is applied thereto. This feature provides the aforesaid benefits of preventing blade misalignment and foreign article entry into the blade environment. A number of additional benefits also derive from the present invention, including improved assurance of terminal to terminal alignment during connector mating and minimization of ergonomic mating force due to the elongation of the staging slots and the beveling of the edge perimeter.

To those skilled in the art to which this invention appertains, the above described preferred embodiment may be subject to change or modification. Such change or modification can be carried out without departing from the scope of the invention, which is intended to be limited only by the scope of the appended claims.

We claim:

1. A multi-blade electrical connector comprising:

a connector body having a first end characterized by a shroud and a second end characterized by a plurality of terminal cavities, said shroud defining a shroud cavity therewithin which communicates with said plurality of terminal cavities, each said terminal cavity being aligned parallel with respect to a terminal axis;

a blade stabilizer located within said shroud cavity, said blade stabilizer having a plurality of blade apertures formed therein, each blade aperture being aligned with a respective terminal cavity;

a releasable interlock interfaced with said shroud and said blade stabilizer which releasably holds said blade stabilizer at a prestage position within said shroud cavity, said blade stabilizer being held at said prestage position by said releasable interlock unless at least a predetermined level of force is applied to said blade stabilizer in a direction parallel to said terminal axis; and a plurality of bladed terminals, each bladed terminal having a blade, each bladed terminal being received in a respective terminal cavity wherein the blade thereof projects into said shroud cavity; wherein when said blade stabilizer is at said prestage position each blade is guidably received by a respective said blade aperture;

wherein said blade stabilizer has an edge periphery, said releasable interlock comprising:

at least one pair of opposed staging nibs formed at said edge periphery; and at least one pair of mutually opposed slot sets formed in said shroud, wherein each staging nib is receivable into a respective slot set;

wherein each said slot set comprises a prestage slot and a staging slot mutually axially aligned parallel to said terminal axis and mutually separated by a prestage detent, wherein when said staging nibs are located in said prestage slots, said blade stabilizer is at said prestage position; and wherein when said staging nibs are at said staging slots, said blade stabilizer is at a range of staged positions so as to be slidable to a location distal from said prestage detent whereat said blade stabilizer is at a fully staged position; and wherein when at least the predetermined level of force is applied to said blade stabilizer, said blade stabilizer snappingly moves from said prestaged position to said range of staged positions.

2. The electrical connector of claim 1, wherein said shroud comprises a top wall and a bottom wall, wherein said at least one pair of mutually opposed slot sets comprises a pair of mutually spaced apart slot sets formed in each of said top and bottom walls; and wherein said blade stabilizer has a top edge periphery and an opposite bottom edge periphery, wherein said at least one pair of opposed staging nibs comprises a pair of mutually spaced apart staging nibs formed at each of said top and bottom edge peripheries.

3. The electrical connector of claim 2, wherein said prestage slots have a first length and said staging slots have a second length, wherein said staging slots are elongated such that said second length exceeds said first length.

4. The electrical connector of claim 3, wherein said blade apertures are beveled on a side thereof facing said terminal cavities.

5. The electrical connector of claim 4, wherein said edge periphery is beveled on the side thereof facing said terminal cavities.

6. The electrical connector of claim 5, wherein a plurality of cutouts are formed in said blade stabilizer.

7. The electrical connector of claim 6, wherein a pair of mutually aligned alignment tabs are formed within said shroud cavity in upstanding relation on said top and bottom walls; and wherein said blade stabilizer further comprises a stabilizer tab formed in upstanding relation on a side of said blade stabilizer facing away from said terminal cavities, wherein said pair of mutually aligned alignment tabs and said stabilizer tab are aligned when said blade stabilizer is at said prestaged position.

8. A multi-blade electrical connector comprising:

a connector body having a first end characterized by a shroud and a second end characterized by a plurality of terminal cavities, said shroud defining a shroud cavity therewithin which communicates with said plurality of terminal cavities, said shroud having formed therein at least one pair of mutually opposed slot sets, each said slot set comprising a prestage slot and a staging slot mutually axially aligned along a terminal axis and mutually separated by a prestage detent;

a plurality of bladed terminals, each bladed terminal having a blade, each bladed terminal being received in a respective terminal cavity wherein the blade thereof projects into said shroud cavity; and a blade stabilizer having a plurality of blade apertures formed therein, said blade stabilizer having an edge periphery, at least one pair of opposed staging nibs being formed at said edge periphery;

wherein each staging nib is receivable into a respective slot set and each blade is guidably received by a respective said blade aperture when said blade stabilizer is received in said shroud cavity.

9. The electrical connector of claim 8, wherein when said staging nibs are located in said prestage slots, said blade stabilizer is at a prestage position; and wherein when said staging nibs are at said staging slots, said blade stabilizer is at a range of staged positions so as to be slidable to a location distal from said prestage detent whereat said blade stabilizer is at a fully staged position;

wherein a tip of each said blade passes through its respective blade aperture when said blade stabilizer is at said prestaged position; and wherein a predetermined force applied to said blade stabilizer causes said blade stabilizer to snappingly move from said prestaged position to said range of staged positions.

10. The electrical connector of claim 9, wherein said shroud comprises a top wall and a bottom wall, wherein said at least one pair of mutually opposed slot sets comprises a pair of mutually spaced apart slot sets formed in each of said top and bottom walls; and wherein said blade stabilizer has a top edge periphery and an opposite bottom edge periphery, wherein said at least one pair of opposed staging nibs comprises a pair of mutually spaced apart staging nibs formed at each of said top and bottom edge peripheries.

11. The electrical connector of claim 10, wherein said prestage slots cooperate with said staging nibs to retain said blade stabilizer at said prestaged position; and wherein said staging slots are elongated such that said nibs are slidable along said staging slots as said blade stabilizer is moved to said fully staged position.

12. The electrical connector of claim 11, wherein said blade apertures are beveled on a side thereof facing said terminal cavities.

13. The electrical connector of claim 12, wherein said edge periphery is beveled on the side thereof facing said terminal cavities.

14. The electrical connector of claim 13, wherein a plurality of cut-outs are formed in said blade stabilizer.

15. The electrical connector of claim 14, wherein a pair of mutually aligned alignment tabs are formed within said shroud cavity in upstanding relation on said top and bottom walls; and wherein said blade stabilizer further comprises a stabilizer tab formed in upstanding relation on a side of said blade stabilizer facing away from said terminal cavities, wherein said pair of mutually aligned alignment tabs and said stabilizer tab are aligned when said blade stabilizer is at said prestaged position.

* * * * *